US005097650A

United States Patent [19]

Olsen

[11] Patent Number: 5,097,650

[45] Date of Patent: Mar. 24, 1992

[54] MULTIPACKAGING METHOD USING CARRIER STOCK FOR SIDE WALL APPLICATION

[75] Inventor: Robert Olsen, Medinah, Ill.

[73] Assignee: Illinois Tool Works Inc., Glenview, Ill.

[21] Appl. No.: 656,565

[22] Filed: Feb. 15, 1991

Related U.S. Application Data

[62] Division of Ser. No. 519,917, May 7, 1990.

[51] Int. Cl.[5] ..... B65B 27/04

[52] U.S. Cl. ..... 53/398; 53/48.3; 53/48.4

[58] Field of Search ..... 53/48.4, 48.5, 398, 53/556, 48.3; 206/150, 151, 145, 199, 153, 158

[56] References Cited

U.S. PATENT DOCUMENTS

| | | | |
|---|---|---|---|
| 3,742,677 | 7/1973 | Best | 53/48.4 |
| 3,816,968 | 6/1974 | Morgan | 53/48.4 |
| 4,018,331 | 4/1977 | Klygas | 206/199 |
| 4,149,631 | 4/1979 | Cunningham | 206/158 X |
| 4,169,343 | 10/1979 | McArdle | 53/48.4 X |
| 4,250,682 | 2/1981 | Braun | 53/48.4 |
| 4,324,085 | 4/1982 | Olsen | 53/48.4 |
| 4,356,914 | 11/1982 | Olsen | 206/150 |
| 4,462,494 | 7/1984 | Cunningham | 206/150 |
| 4,782,955 | 11/1988 | Weaver et al. | 206/161 |
| 4,817,361 | 4/1989 | Cunningham | 53/48.4 |

*Primary Examiner*—John Sipos

*Attorney, Agent, or Firm*—Dressler, Goldsmith, Shore, Sutker & Milnamow, Ltd.

[57] ABSTRACT

Carrier stock formed from a single sheet of resilient polymeric material, such as low density polyethylene, for machine application to side walls of substantially identical containers. Integrally joined band segments defining separate apertures to receive the individual containers include longitudinal, cross, and diagonal segments. The diagonal segments are joined at generally X-shaped junctions. From each junction, the generally oblique segments of a first pair are continuously curved toward the nearer edge of such stock and the diagonal segments of a second pair are substantially straight and tend toward the other edge of such stock. Each diagonal segment of the first pair at each junction has a progressively changing width, being wider at its end joined at such junction than at its other end, and has a substantially uniform width.

7 Claims, 3 Drawing Sheets

MULTIPACKAGING METHOD USING CARRIER STOCK FOR SIDE WALL APPLICATION

This application is a division of application Ser. No. 07/519,917, filed May 7, 1990.

TECHNICAL FIELD OF THE INVENTION

This invention pertains to carrier stock for machine application to substantially identical cans or other containers. This invention pertains, more particularly, to carrier stock for machine application to the side walls of such containers.

BACKGROUND OF THE INVENTION

Typically, carrier stock with individual container-receiving apertures for machine application to substantially identical containers is formed, as by die-cutting, from a single sheet of resilient polymeric material, such as low density polyethylene.

An example of such stock for machine application to substantially identical containers in three longitudinal rows of indeterminate length is disclosed in Klygis U.S. Pat. No. 4,018,331. As disclosed therein, such stock may be transversely severed, after it has been applied to such containers, to produce packages with three containers, six containers, or other multiples of three containers. A suitable machine for applying such stock is disclosed in Benno et al. U.S. Pat. No. 3,959,949.

Typically, each such container has a chime formed on its upper end, or on each of its ends. In machine application of carrier stock to such containers, it is conventional to apply such stock to the upper ends of the containers, in such manner that edges of band segments of the stock bear upwardly against the chimes when the individual carriers severed from the stock are lifted via finger apertures formed in the stock.

However, it has been suggested (see, e.g., Klygis patent, supra. column 2, lines 43 through 45) that such stock may be alternatively applied to other portions of such containers, such as lower end portions of such containers. It would be particularly desirable to apply such stock to the side walls of such containers.

As disclosed in a co-pending application filed May 7, 1990, by Lonnie Ray Seymour and Kevin Dewain Moore, under Ser. No. 07/519,860, and assigned commonly herewith, a machine has been developed for applying such stock to the side walls of such containers. The co-pending application is entitled "Apparatus and Method for Applying Multi-Package Device."

The machine disclosed in the co-pending application noted above employs two camming plates, which have edge contact with the stock as the stock is moved through the machine, to cam the stock downwardly along the side walls of the containers. Considerable friction is created between the plate edges and the moving stock. Such friction tends to cause necking down or breaking at diagonal band segments near the outer edges of carrier stock according to prior designs.

A need has been created, to which this invention is addressed, for carrier stock that can be effectively applied to the side walls of such containers, as by the machine disclosed in the copending application noted above, with minimal risk of necking down or breaking of diagonal band segments near the outer edges of such stock.

SUMMARY OF THE INVENTION

This invention provides carrier stock formed from a single sheet of resilient polymeric material, such as low density polyethylene, for machine application to substantially identical containers. Such stock is designed particularly but not exclusively for machine application to the side walls of such containers. Notably, such stock is formed with specific band segments having progressively changing widths to minimize necking down or breaking of such specific segments.

The carrier stock provided by this invention is severable to form individual containers with separate apertures to receive the individual containers when the stock is machine-applied to the side walls of such containers. The separate apertures are in rectangular arrays with longitudinal rows, three rows being preferred, and transverse ranks. Such stock has two opposite edges, one or both of which may be optionally provided with an integral handle for each individual carrier.

The carrier stock provided by this invention is formed with integrally joined band segments defining the separate apertures. These segments include longitudinal segments, cross segments, and diagonal segments. The longitudinal segments define the opposite edges of such stock. The cross segments extend transversely.

Each diagonal segment has a first end where it is joined to one of the generally transverse segments and a second end where it is joined to three more of the diagonal segments at a junction. Each junction is generally X-shaped when such stock is unstressed.

Also, each junction is defined by two pairs of the diagonal segments, namely a first pair and a second pair. From each junction, the diagonal segments of the first pair diverge toward the nearer edge of the carrier stock, whereas the diagonal segments of the second pair diverge toward the other edge of such stock.

It is contemplated by this invention that at least one diagonal segment of the first pair extending from at least one junction has a progressively changing width when the carrier stock is unstressed. Specifically, the second end of each diagonal segment having such a progressively changing width is wider than its second end. Preferably, each diagonal segment of the first pair at each junction has such a progressively changing width.

Preferably, if the separate apertures are in three longitudinal rows, each diagonal segment of the second pair at each junction has a substantially uniform width when the carrier stock is unstressed. It is preferred, moreover, that each diagonal segment of the first pair at each junction has curved edges when such stock is unstressed.

Carrier stock according to this invention can be effectively applied to the side walls of substantially identical containers, as by the machine disclosed in the co-pending application noted above, with minimal risk of necking down or breaking at the diagonal segments of constituting the first pair extending from each junction.

These and other objects, features, and advantages of this invention are evident from the following description of a preferred embodiment of this invention with reference to the accompanying drawings.

DETAILED DESCRIPTION OF PREFERRED EMBODIMENT

Figure 1:
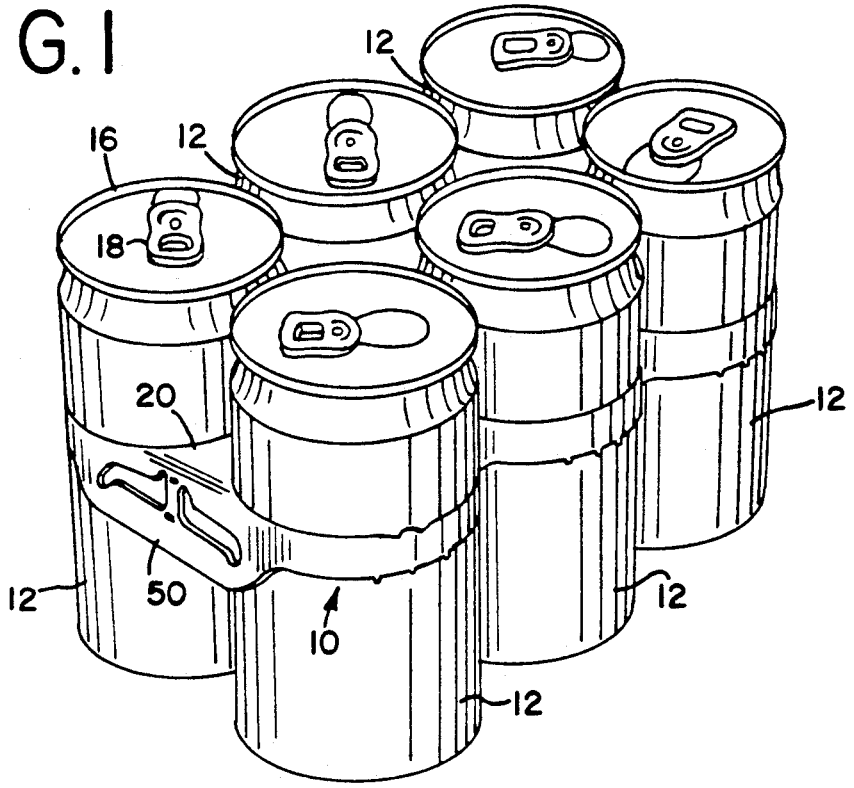
FIG. 1 is a perspective view of a package comprising six identical containers and a carrier, which has an integral handle, and which is severed from carrier stock according to this invention.
Figure 3:
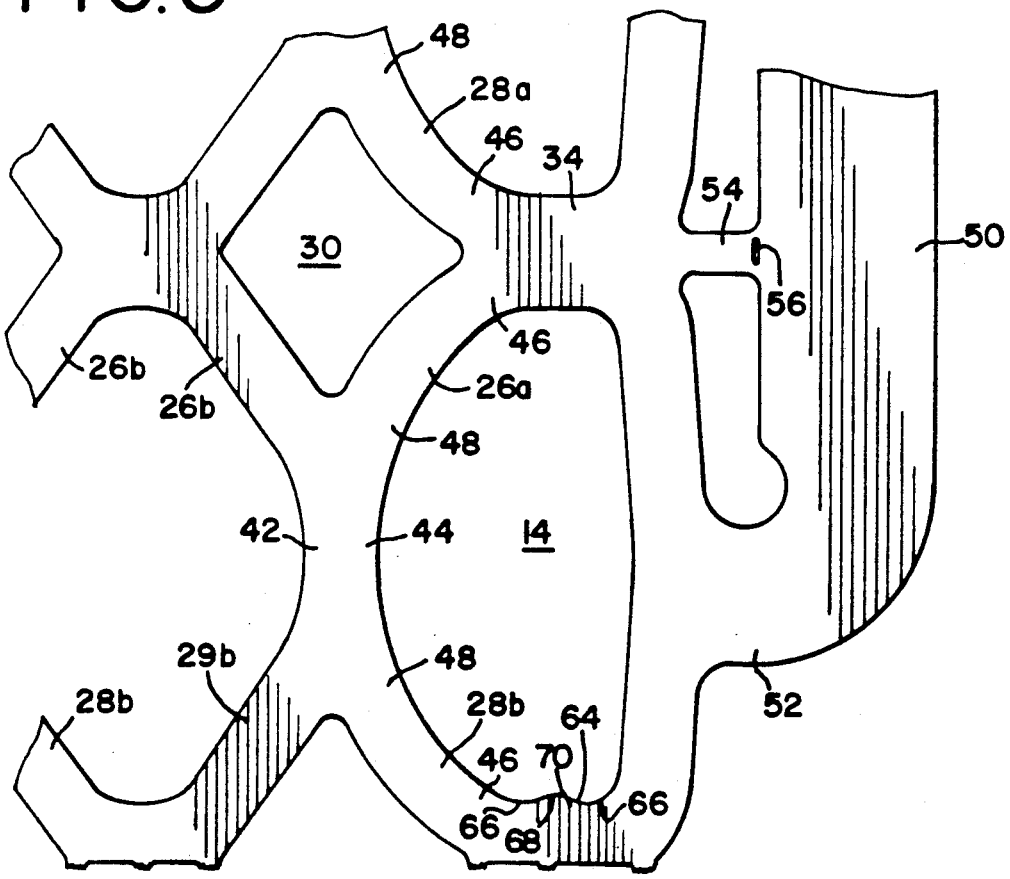
FIG. 3 is an enlarged detail taken from FIG. 2 to show certain band segments with characteristic shapes contemplated by this invention.
Figure 2:
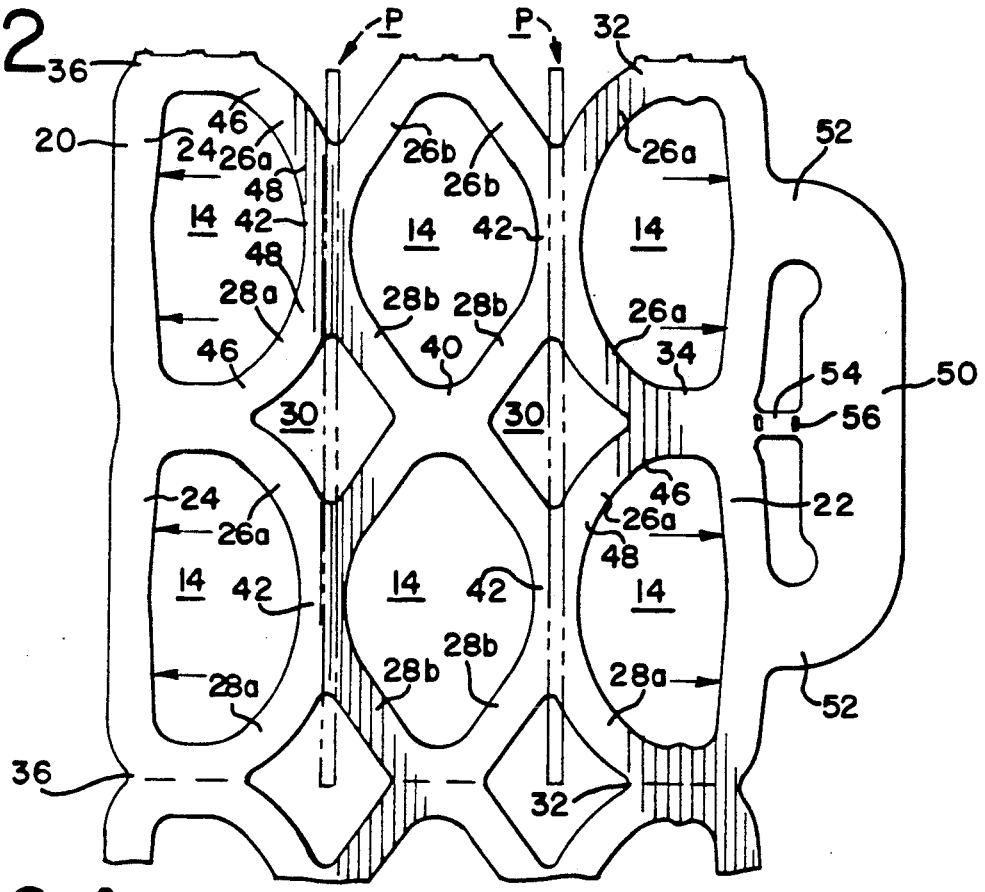
FIG. 2 is a plan view of carrier stock according to the preferred embodiment of this invention.

As shown in FIGS. 1 through 3, carrier stock 10 for machine application to substantially identical containers 12 constitutes a preferred embodiment of this invention. Such stock 10 is formed with separate apertures 14 to receive the individual containers 12. The carrier stock 10 is severable, along transverse lines to be later described, to form individual carriers 20 that are substantially identical.

As shown in FIG. 1, the containers 12 are beverage cans of a type used commonly for beer, soft drinks, and other beverages. Also, each container 12 has a chime 16 at one end, which is provided with a pull tab 18. This invention is not limited, however, to usage with such cans but is useful with cans, bottles, and other containers of various types.

In FIG. 1, a package is shown, which comprises six such containers 12 and one such carrier 20, as severed from such stock 10. One such carrier 20 is shown fully in FIG. 2, which also shows fragmentary portions of the next carrier 20. Each carrier 20 is shown in an unstressed condition in FIG. 2.

The carrier stock 10 is formed in an indeterminate length, as by die-cutting, from a single sheet of resilient polymeric material. A preferred material is low density polyethylene. A preferred thickness for such stock 10 in an unstressed condition, if low density polyethylene is used, is about 14 mils.

The carrier stock 10 is formed, for each individual carrier 20, with integrally joined band segments defining six separate apertures 14. As shown in FIG. 2, such apertures are in a rectangular array with longitudinal rows and transverse ranks, namely three longitudinal rows and two transverse ranks for each individual carrier 20.

The carrier stock 10 is applied to the side walls of the respective containers 12 away from the chime 16 of each container 12. The stock 10 is designed to be effectively applied by the machine disclosed in the co-pending application noted above.

Figure 5:
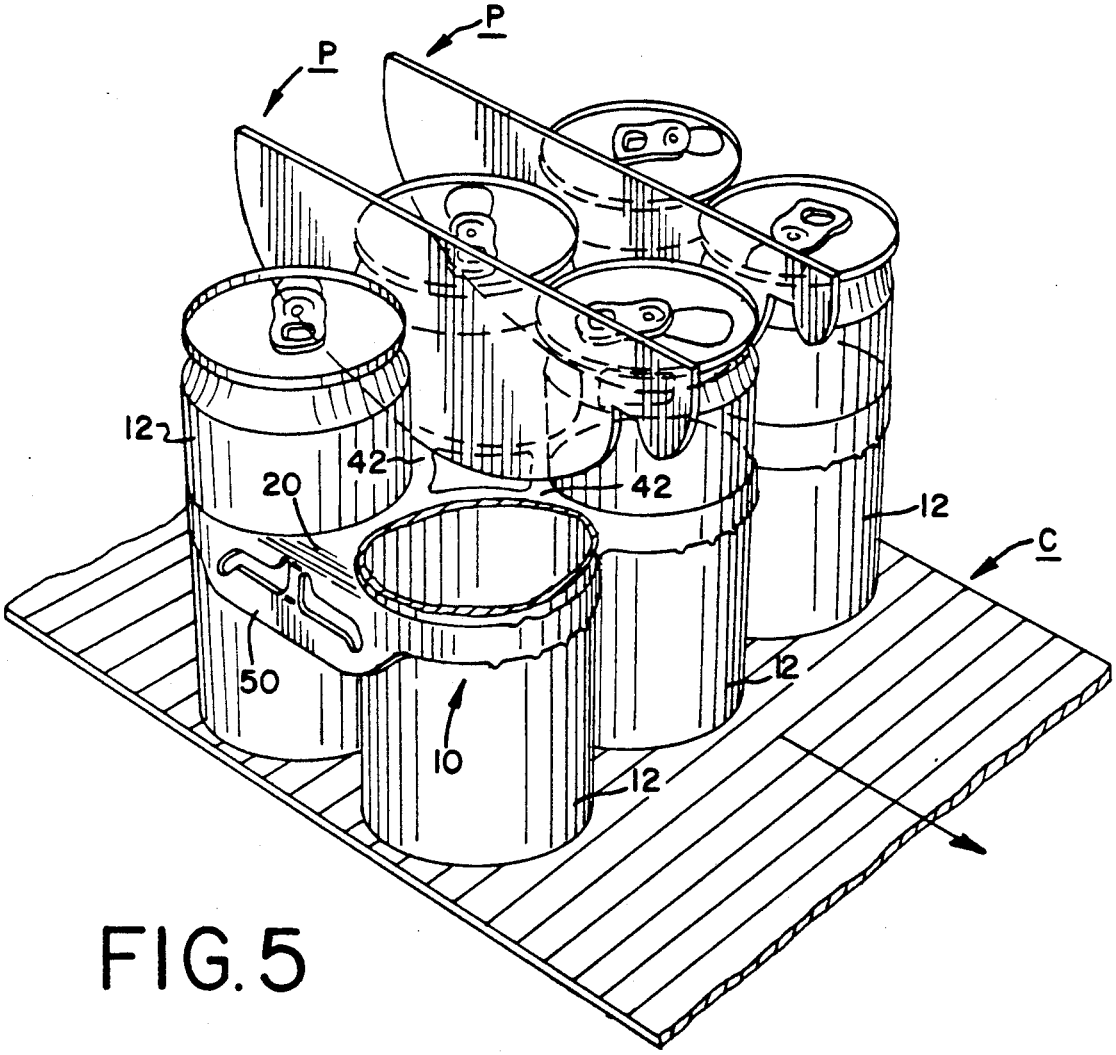
FIG. 5 is a perspective view showing where certain elements of a machine contact carrier stock according to the preferred embodiment of this invention as such stock is applied to six substantially identical containers. One of the containers is shown fragmentarily without its contents.

As shown in FIG. 5, the machine comprises a conveyer C, which is used to convey an indeterminate number of the containers 12 in a rectangular array with three longitudinal rows and an indeterminate number of transverse ranks, three transverse ranks being shown. Moreover, the machine comprises two camming plates P fixed in parallel relation to each other, and in edge contact with the carrier stock 10 as the stock 10 is moved through the machine. Further details of the machine may be found by reference to the co-pending application noted above.

Because the carrier stock 10 is applied to the side walls of the respective containers 12, the carrier stock 10 requires less material and can be thus made of thinner material with band segments of narrower width, as compared to carrier stock (not shown) applied directly beneath chimes like the chimes 16, which are abutted by edges of such stock.

The band segments include relatively narrow outer and diagonal segments and relatively wide cross segments. The outer segments include outer segments 22 extending along what may be hereinafter called the handle edge of such stock 10 and outer segments 24 extending along the opposite edge of such stock 10. The outer segments 22, 24, extend in a generally longitudinal direction, which is the machine direction, when such stock 10 is unstressed. The diagonal segments extend generally along diagonal lines when the stock 10 is unstressed. The diagonal segments include diagonal segments 26*a*, 28*a*, and diagonal segments 26*b*, 28*b*. The diagonal segments define generally diamond-shaped apertures 30. The cross segments include cross segments 32, 34, joined directly to the outer segments 22, at one edge and cross segments 36, 38, joined directly to the outer segments 24 at the opposite edge, and cross segments 40 extending between the apertures 30.

While the preferred embodiment of the invention shows segments 26*a* and 28*a* as curved and segments 26*b* and 28*b* as straight, it should be apparent that segments 26*a* and 28*a* may be straight or segments 26*a* and 28*b* may be curved without altering the scope and spirit of the invention.

Because the carrier stock 10 is formed with the generally diamond-shaped apertures 30 defined by the diagonal segments 26*a*, 28*a*, 26*b*, 28*b*, excess material is omitted from such stock 10. There are consequent savings in cost and weight.

The carrier stock 10 is formed, for each individual carrier 20, with junctions 42 where each of the diagonal segments is joined to three more of the diagonal segments. Each junction 42 is generally X-shaped with an elongate midportion 44, as shown in FIG. 2, when such stock 10 is unstressed. Also, each junction 42 is defined by two pairs of the diagonal segments, namely a first pair comprised of one of the diagonal segments 26*a* and one of the diagonal segments 28*a* and a second pair comprised of one of the diagonal segments 28*b* and one of the diagonal segments 28*b*.

From each junction 42, the diagonal segments 26*a*, 28*a*, of the first pair diverge toward the nearer edge of the carrier stock 10. From each junction 42, the diagonal segments 26*b*, 28*b*, of the second pair diverge toward the other edge of such stock 10.

Each of the diagonal segments 26*a*, 28*a*, has a first end 46 where it is joined to one of the cross segments 32, 34, 36, 38, and a second end 48 where it is joined at one of the junctions 42. Moreover, each of the diagonal segments 26*a*, 28*a*, has a progressively changing width when the carrier stock 10 is unstressed. Specifically, the second end 48 of each of the diagonal segments 26*a*, 28*a*, is wider than its first end 46.

The wider characteristic of the second ends 48 serves to better accept the high stress placed on these regions of the bands as a result of the frictional contact between camming plates P (shown in phantom lines in FIG. 2) and the junction 42.

Furthermore, each of the diagonal segments 26*a*, 28*a*, has curved edges, as shown in FIG. 2, when such stock 10 is unstressed. One of the curved edges is convex and borders one of the apertures 14. The other curved edge is convex.

Each of the diagonal segments 26b, 28b, may also have progressively changing width, i.e., wider at the junction 42 than at the cross segment 40, when the carrier stock 10 is unstressed. Moreover, each of the diagonal segments 26b, 28b, has straight edges when such stock 10 is unstressed.

Moreover, for each individual carrier 20, the carrier stock 10 may be formed with an integral handle 50 formed at the outer segments 22. The handle 50 has two ends 52 and a middle leg 54 between the ends 52. The middle leg 54 is joined to a node (where the outer segments 22 are joined) via a perforated line 56 defining a break-away joint. The break-away joint enables the middle leg 54 to be easily broken away from other portions of the handle 50 when lifted, but remains tied to the outer band segment to assist in winding of the product in the production mode. Once the middle leg 54 has been broken away, the handle 50 and the outer segments 22 define a finger aperture that can be sufficiently large to accommodate two or more fingers of a user's hand.

Further details of the juncture of each end 52 of the handle 50 to other portions of the carrier stock 10 and of the characteristic shape of certain aperture-defining edges 64 (which are configured with concave sections 66 and convex sections 68 defining nubs 70) are disclosed in a co-pending application filed simultaneously herewith, by Leslie S. Marco and Robert Olsen, under Serial No. 07/519,859, and assigned commonly herewith, for "Carrier Stock With Integral Handles."

When the carrier stock 10 is applied, as by the machine discussed above, lateral forces are applied to the outer segments 24, as suggested by arrows in FIG. 2. These forces tend to stretch the band segments, particularly but not exclusively the diagonal segments 26a, 28a. Moreover, the camming plates P bear downwardly against the junctions 42, as shown in FIGS. 2 and 5, and produce considerable friction between such plates P and the junctions 42. Consequently, the band segments 26a, 28b, at regions adjacent the junctions 42 tend to be particularly vulnerable to necking down or breaking due to this excessive stress concentration.

Because of its characteristic features including the progressively changing widths of the diagonal segments 26a, 28a, which have curved edges when the carrier stock 10 is unstressed, the carrier stock 10 can be effectively applied to the side walls of the containers 12, as by the machine discussed above, with minimal risk of necking down or breaking of any of the diagonal segments 26a, 28a.

Preferably, the carrier stock 10 has an asymmetrical configuration, as disclosed in Olsen et al. U.S. Pat. No. 4,356,914.

Figure 4:
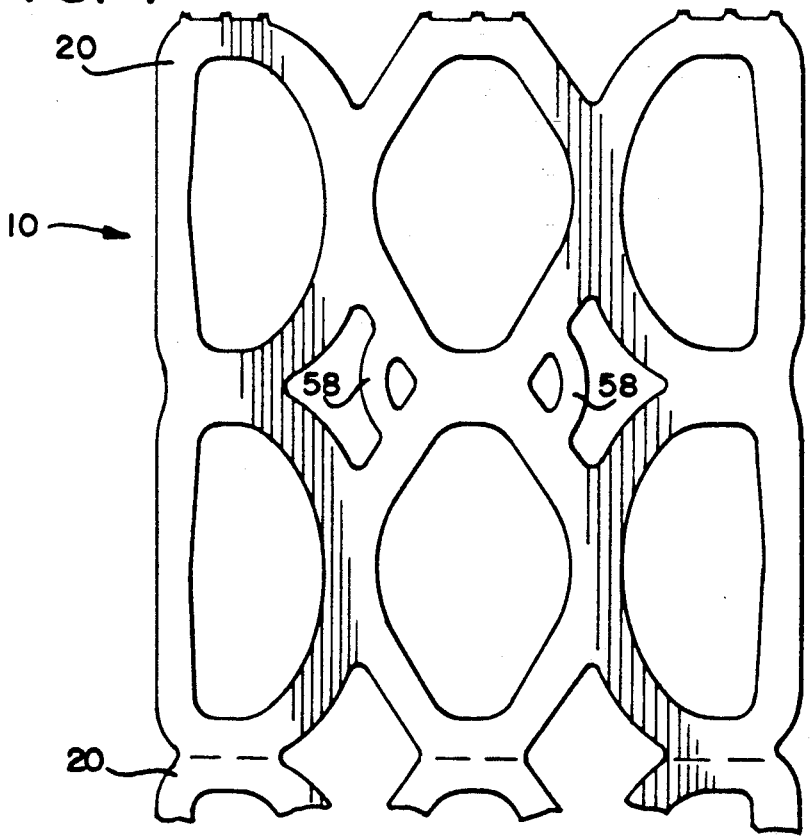
FIG. 4 is a plan view of carrier stock according to an alternate embodiment of this invention.

As shown in FIG. 4, in which an alternate embodiment of this invention is shown, the handles 50 for each individual carrier 20 may be omitted from the carrier stock 10 and band segments 58 serving as finger-gripping means may be provided instead, as disclosed in Klygis U.S. Pat. No. 4,018,331.

Various modifications may be made in the carrier stock 10 without departing from the scope and spirit of this invention.

I claim:

1. A packaging method for multipackaging at least three substantially adjacent rows of container having opposite ends into packages of a selected number of containers, each container being provided at one end with a chime, the method comprising the steps of:

providing a carrier stock formed from a single sheet of resilient polymeric material being severable to form individual carriers with separate apertures in rectangular arrays with at least three longitudinal rows and plural transverse ranks to receive the individual containers, said stock having two opposite edges, said stock being formed with integrally joined band segments defining the separate apertures, said segments including outer segments defining the opposite edges of said stock, cross segments extending transversely, and diagonal segments, each diagonal segment having a first end where such diagonal segment is joined to one of the cross segments and a second end where such diagonal segment is joined to three more of the other diagonal segments at a junction, each junction being generally x-shaped when said stock is unstressed and being further defined by two such diagonal segments constituting a first pair and diverging from such junction toward the near edge of said stock and by two such diagonal segments constituting a second pair and diverging from such junction toward the other edge of said stock, at least one diagonal segment of the first pair extending from at least one such junction having progressively changing width when said stock is unstressed with it second end where it is joined to three more of the other diagonal segments being wider than its first end where it is joined to one of the cross segments;

applying transverse stretching forces to opposite edges of the stock to reconfigure the apertures;

applying downward and linearly directed longitudinal forces to the junctions of the stock by camming plates to force the stock downward on the side walls of the containers to a position spaced from the chimes and opposite ends of the containers, moving the containers and the camming plates relative to each other to create said applying forces, wherein the step of the applying said forces produces considerable friction between the camming plates and the stock, and wherein the widened portions of the diagonal segments accept the stress created by the camming plates with minimal risk of necking down or breaking said diagonal segments.

2. The packaging method of claim 1 wherein the chimes are provided at upper ends of the containers and wherein the step of applying said forces comprises applying downward and lineal directed longitudinal forces to the junctions of the stock by camming plates to force the stock downward on the side walls of the containers, past the chimes of the container, to a position wherein the band segments of the stock are spaced below the chimes of the containers.

3. A packaging method for multipackaging three substantially adjacent rows of containers having opposite ends into packages of a selected number of containers, each container having provided at one end with a chime, the method comprising the steps of:

providing a carrier stock formed from a single sheet of resilient polymeric material being severable to form individual carriers with separate apertures in rectangular arrays with three longitudinal rows and plural transverse ranks to receive the individual containers, said stock having two opposite edges, said stock being formed with integrally joined band segments defining the separate apertures, said segments including outer segments defining the opposite edges of said stock, cross segments extending transversely and diagonal segments, each diagonal segment having a first end where such diagonal segment is joined to one of the cross segments and a second end where such diagonal segment is joined to three more of the other diagonal segments at a junction located between an outer one of said longitudinal rows and a middle one of said longitudinal rows, each junction being generally x-shaped when said stock is unstressed and being further defined by two such diagonal segments constituting a first pair and diverging from such junction toward the nearer edge of said stock and by two such diagonal segments constituting a second pair and diverging from such junction toward the other edge of said stock, at least one diagonal segment of the first pair extending from each such junction having a progressively changing width when said stock is unstressed with its second end where it is joined to three more of the diagonal segments being wider than its first end where it is joined to one of the cross segments;

applying transverse stretching forces to opposite edges of the stock to reconfigure the apertures; and applying downward and linearly directed longitudinal forces to the junctions of the stock by camming plates to force the stock downward on the side walls of the containers to a position spaced from the chimes and opposite ends of the containers;

moving the containers and the camming plates relative to each other to create said applying forces, wherein the step of applying said forces produces considerable friction between the camming plates and the stock and wherein the widened portions of the diagonal segments accept the stress created by the camming plates with minimal risk of necking down or breaking said diagonal segments.

4. The packaging method of claim 3 wherein the chimes are provided at upper ends of the containers and wherein the step of applying said forces comprises applying downward and lineal directed longitudinal forces to the junctions of the stock by camming plates to force the stock downward on the side walls of the containers, past the chimes of the container, to a position wherein the band segments of the stock are spaced below the chimes of the containers.

5. In a system for multipackaging at least three substantially adjacent rows of containers having opposite ends into packages of a selected number of containers using:

a carrier stock formed from a single sheet of resilient polymeric material being severable to form individual carriers with separate apertures in at least three longitudinal rows and plural transverse ranks to receive the individual containers, said stock having two opposite edges, said stock being formed with integrally joined band segments defining the separate apertures, said segments including outer segments defining the opposite edges of said stock, cross segments extending transversely, and diagonal segments, each diagonal segment having a first end where such diagonal segment is joined to one of the cross segments and a second end where such diagonal segment is joined to three more of the other diagonal segments at a junction, each junction being generally X-shaped when said stock is unstressed and being further defined by two such diagonal segments constituting a first pair and diverging from such junction toward the nearer edge of said stock and by two such diagonal segments constituting a second pair and diverging from such junction toward the nearer edge of said stock and by two such diagonal segments constituting a second pair and diverging from such junction toward the other edge of said stock, each diagonal segment of the first pair of each such junction having a progressively changing width with its second end where it is joined to three more of the other diagonal segments being wider than its first end where it is joined to one of the cross segments;

said containers comprising a plurality of substantially identical containers having side walls, each container being provided at one end with a chime, each container being received by a respective one of the apertures of at least one of the transverse ranks;

said system comprising means comprising a plurality of camming plates for bearing against the junctions so as to apply downward and linearly directed longitudinal forces to the junctions, said forces tending to force the stock downward on the side walls of the containers in the longitudinal rows adjacent to the junctions to a position wherein the band segments of the stock are spaced from the chimes and opposite ends of the containers thereby creating considerable friction between the camming plates and the stock, the widened segments accepting the stress created by the camming plates with minimal risk of necking down or breaking said diagonal segments, and means for moving the containers and the camming plates relative to each other to create said applying forces.

6. The combination of claim 5 wherein the apertures are disposed in three longitudinal rows and wherein said means comprises two camming plates in transversely spaced relation to each other.

7. The combination of claim 5 wherein each container is provided at an upper end with a chime and wherein said means is arranged to apply downward and linearly directed longitudinal forces to the junctions so as to force the stock downward on the side walls of the containers in the longitudinal rows adjacent to the junctions to a position wherein the band segments are spaced below the chimes of the containers.

* * * * *

UNITED STATES PATENT AND TRADEMARK OFFICE

CERTIFICATE OF CORRECTION

PATENT NO. : 5,097,650

DATED : March 24, 1992

INVENTOR(S) : Robert Olsen

It is certified that error appears in the above-identified patent and that said Letters Patent is hereby corrected as shown below:

Title Page, Item [56]under "References Cited", "Klygas" should be --Klygis--.

Column 4, lines 44 "28b" should be --26b--.

Column 5, lines 27 and 28, "simultaneously herewith" should be --May 7, 1990--, per Preliminary Amendment dated February 15, 1991.

Column 5, line 28, "07/519,859" should be --07/519,858--.

Col. 6, line 27, first occurrence of "it" should be --its--.

Column 6, line 59, "having" should be --being--.

Signed and Sealed this

Twelfth Day of October, 1993

Bruce Lehman

*Attest:*

BRUCE LEHMAN

*Attesting Officer*

*Commissioner of Patents and Trademarks*